United States Patent [19]

Kondo et al.

[11] 4,269,102

[45] May 26, 1981

[54] KEY ASSIGNOR

[75] Inventors: Tatsunori Kondo; Hiroshi Kitagawa, both of Hammamatsu, Japan

[73] Assignee: Kabushiki Kaisha Kawai Gakki Seisakusho, Hamamatsu, Japan

[21] Appl. No.: 135,997

[22] Filed: Mar. 31, 1980

Related U.S. Application Data

[63] Continuation-in-part of Ser. No. 842,524, Oct. 17, 1977, abandoned.

[30] Foreign Application Priority Data

Apr. 26, 1976 [JP] Japan ..... 51-47559

[51] Int. Cl.[3] ..... G10H 1/00; G08C 9/00

[52] U.S. Cl. ..... 84/1.01; 84/DIG. 2; 340/365 S

[58] Field of Search ..... 84/1.01, 1.03, 1.17, 84/DIG. 2, DIG. 7; 340/147 LP, 166 R, 365 S, 365 R

[56] References Cited

U.S. PATENT DOCUMENTS

| | | | |
|---|---|---|---|
| 3,882,751 | 5/1975 | Tomisawa et al. | 84/1.01 |
| 3,981,217 | 9/1976 | Oya | 84/1.03 |
| 4,041,825 | 8/1977 | Pascetta et al. | 84/1.01 |
| 4,041,826 | 8/1977 | Oya | 84/1.01 |
| 4,138,916 | 2/1979 | Kitagawa | 84/DIG. 2 |
| 4,138,917 | 2/1979 | Sakashita et al. | 84/1.01 |
| 4,148,017 | 4/1979 | Tomisawa | 84/1.01 |
| 4,170,768 | 10/1979 | Kitagawa | 340/365 S |
| 4,194,425 | 3/1980 | Kitagawa | 84/1.01 |

*Primary Examiner*—J. V. Truhe
*Assistant Examiner*—Forester W. Isen

[57] ABSTRACT

A key assignor for electronic musical instruments which has a keyboard multiplexer including a memory for temporarily storing the state of key depression on a keyboard, a key priority circuit group operating to output only key information of top priority while inhibiting the other key information outputs in accordance with priority of keys of the keyboard and to output key information of the next priority after being reset, and a multiplex code generator for generating the key code corresponding to the key being depressed, a channel assignor for giving priority to channels to assign thereto the key code from the keyboard multiplexer, and a key code memory for storing the key code from the keyboard multiplexer based on a channel assign signal generated from the channel assignor.

2 Claims, 11 Drawing Figures

OUTPUT (FIG.2)
41
FIG. 3A CLOCK
45 Q
FIG. 3B FREQUENCY DIVIDER
46 a
FIG. 3C GATE
47 b
FIG. 3D GATE
43 c
FIG. 3E GATE
FIG. 3F BUS-LINE
42 e
FIG. 3G GATE
48 Q
FIG. 3H FF

KEY ASSIGNOR

RELATIONSHIP TO OTHER APPLICATIONS

This application is a continuation-in-part application to Ser. No. 842,524 filed Oct. 17, 1977, now abandoned, by the present inventors.

BACKGROUND OF THE INVENTION

1. Field of the Invention

This invention relates to a key assignor having a keyboard multiplexer for electronic musical instruments.

2. Description of the Prior Art

In apparatus having a large number of key switches, such as an electronic organ, a large amount of wiring is required for directly connecting the key switches to desired circuits so that on-off information of the former may be supplied to the latter. To avoid this, there has usually been employed a time division multiplex system in which the key switches are scanned on a time shared basis to obtain and apply the on-off information in the form of a TDM (Time Division Multiplex) or PCM (Pulse Code Modulation) signal to a key code memory. With this system, however, since the on-off state of the key switches is checked on the time shared basis, information of the key switches in the off state is also sent to the key code memory. This requires one scanning period for sending required information and a clock of a very high frequency, for instance, several hundred kilohertzes, for providing a rapid response to key depression and release. Further, the response time lags due to the relationship of the moments of key depression and release to one scanning period: for example, when a depressed key switch is released immediately after being scanned, the response time lags about one scanning period. An improvement that has been made on the abovesaid method is to temporarily stop scanning of an output line for a predetermined period of time upon key code generation by key depression and to rapidly effect the aforesaid scanning while no key code signal is generated. Also, with this method, however, whether depressed or not, the key switches are all scanned through at a high speed, so that the scanning is still time-consuming. Moreover, circuit integration imposes a limitation on high-speed scanning.

In U.S. Pat. No. 3,981,217 there is described another key assignor for use in an electronic musical instrument which is capable of detecting changes in key switches by comparing the previous on/off state of the key switches with previous on/off states thereof. However, the present invention distinguishes over that patent in the provision of a second memory circuit and in the method of feeding back processed depressed key information.

In the aforementioned referenced patent, a signal selected by the priority circuit directly controls the key code generator. In the present invention, a signal selected by the priority circuit is temporarily stored in the second memory circuit, and by the stored signal, the key code generator is activated.

With the feedback method of the referenced patent, a key code assigned is read from a key code memory circuit, decoded, and then stored in a key code signal generator, thereafter being fed back to a change detector. In contrast thereto, in the present invention, a depressed key signal is transferred from the second memory to a third memory and then fed back to the inhibit circuit. Accordingly, in the present invention, the depressed key signal is applied from the third memory directly to the inhibit circuit.

SUMMARY OF THE INVENTION

This invention has for its object to provide a key assignor for electronic musical instruments which is free from the abovesaid defects experienced in the prior art and which dispenses with key scanning, has a small response time lag and employs a low clock frequency necessary for outputting key code data.

The abovesaid objective can be achieved by providing a key assignor which has a keyboard multiplexer comprising a memory for temporarily storing the state of key depression on a keyboard, a key priority circuit operating to provide only key information of top priority while inhibiting the other key information outputs in accordance with priority of keys of the keyboard and to output key information of the next priority after being reset and a multiplex code generator for generating the key code corresponding to key depression, a channel assignor for giving priority to each channel for assigning thereto a keycode provided from the keyboard multiplexer, and a key code memory for storing the key code from the keyboard multiplexer based on a channel assign signal provided from the channel assignor.

DESCRIPTION OF THE PREFERRED EMBODIMENTS

Figure 1:
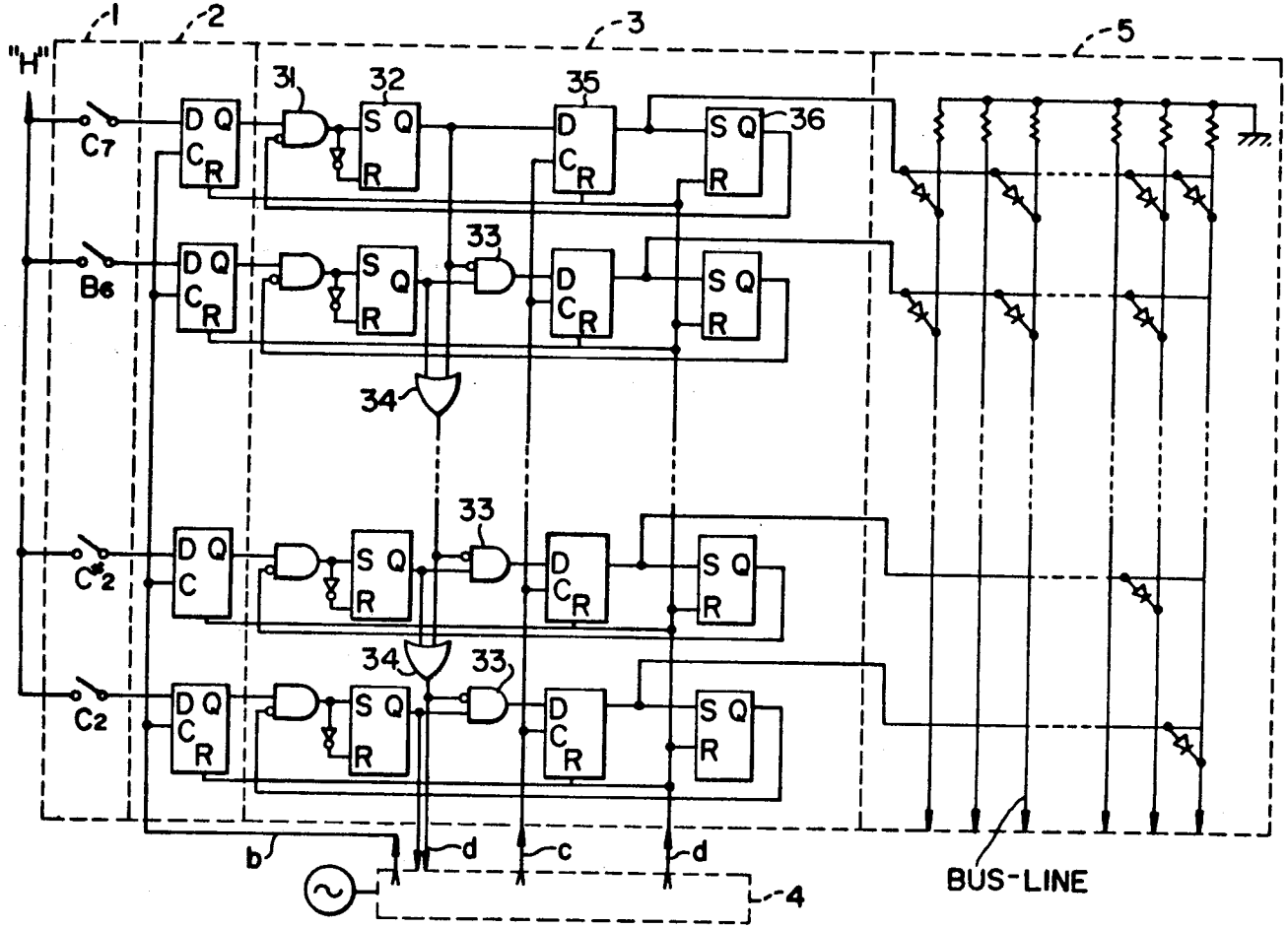
FIG. 1 is an explanatory diagram showing the construction of an embodiment of this invention.
Figure 3:
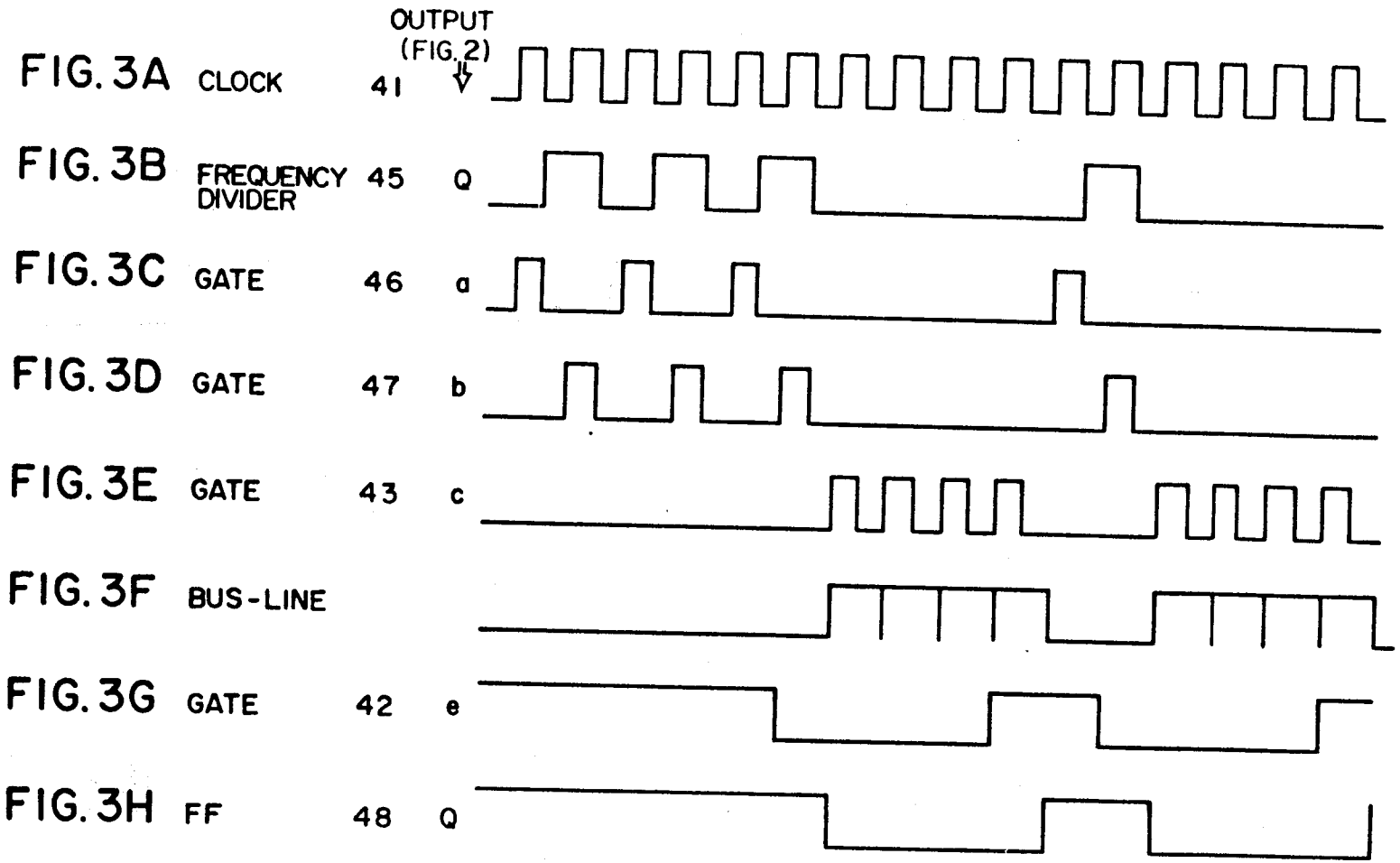
FIGS. 3A and 3H, inclusive show a timing chart explanatory of the operation of the principal part depicted in FIG. 2.

FIG. 1 schematically illustrates the construction of an embodiment of this invention. In FIG. 1, reference numeral 1 indicates a key switch group; 2 designates a latch circuit group; 3 identifies a reset type high-pitched tone priority circuit; 4 denotes a control pulse generator; and 5 represents a multiplex key code generator. FIG. 3 is a block diagram showing in detail the control pulse generator 4 illustrated in FIG. 1. Output pulses a, b and c from the control pulse generator 4 and input pulses d and e thereto are to control the circuit operation described later.

The key switches 1 are connected at one end to a high level "H" (the power source voltage). Upon turning ON of some of keys $C_7$, $B_6$, . . . $C_2$# and $C_2$ respectively corresponding to higher-pitched or lower-pitched tones, the control pulse b of the control pulse generator (refer to FIG. 2) is applied to the latch circuits 2 corresponding to the depressed key switches 1 to provide "1" at the outputs of the gates 31 of the reset type high-pitched tone priority circuit 3. As a result of this, the Q outputs from RS flip-flops 32 become "1." The Q outputs from the RS flip-flops 32 are given priority by gates 33 in order of tone pitch (Since this is the case of giving top priority to the highest-pitched tone, the gate 33 is not required for the highest-pitched tone, and hence is omitted). Namely, only that one of the ON signals of the depressed key switches which corresponds to the tone higher in pitch than any others, is permitted to pass through the corresponding gate 33. The key ON signals of the lower priority are all inhibited through gates 34. Next the output from the above said gate 33 is applied to the latch circuit 35, from which is provided a signal "1" based on the control pulse c from the control pulse generator 4. The output signal "1" causes the multiplex key code generator 5 to provide on a bus line the key code corresponding to the selected one of the depressed key switches. On the other hand, the output from the latch circuit 35 is connected to the set (S) terminal of an RS flip-flop 36, whose Q output becomes "1," so that the gate 31 supplied with this output is put in its inhibited state.

Consequently, the RS flip-flop 32 is reset to provide "0" at its Q output. As a result of this, the top priority of the selected depressed key switch is lost and top priority is given to the next highest pitched-tone. In this case, since top priority is shifted by a priority logic circuit from the highest-pitched tone to the next one without sequentially scanning the depressed keys between those corresponding to the highest-pitched tone and the next one unlike in the prior art, the operation is achieved in a moment. Thereafter, top priority is similarly given to lower-pitched tones one after another. When the key code has been finally provided which corresponds to the tone in pitch lower than any other tones of the key switches depressed concurrently, a gate 42, shown in FIG. 2, becomes operative to actuate a D type flip-flop 48 to provide synchronization with a clock from a clock source 41, stopping the supply of the pulse c to the pulse generator of the latch circuit 35. On the other hand, the gate 44 becomes operative and a pulse frequency divided by ½ frequency divider 45 is applied to gates 46 and 47 to derived therefrom the control pulses a and b, respectively. With the pulse a the latch circuit group 2, the latch circuit 35 and the RS flip-flop 36 are reset and then, with the pulse b, the latch group 2 latches the next key ON-OFF state. Thereafter the same operations as the abovesaid are carried out respectively.

Figure 2:
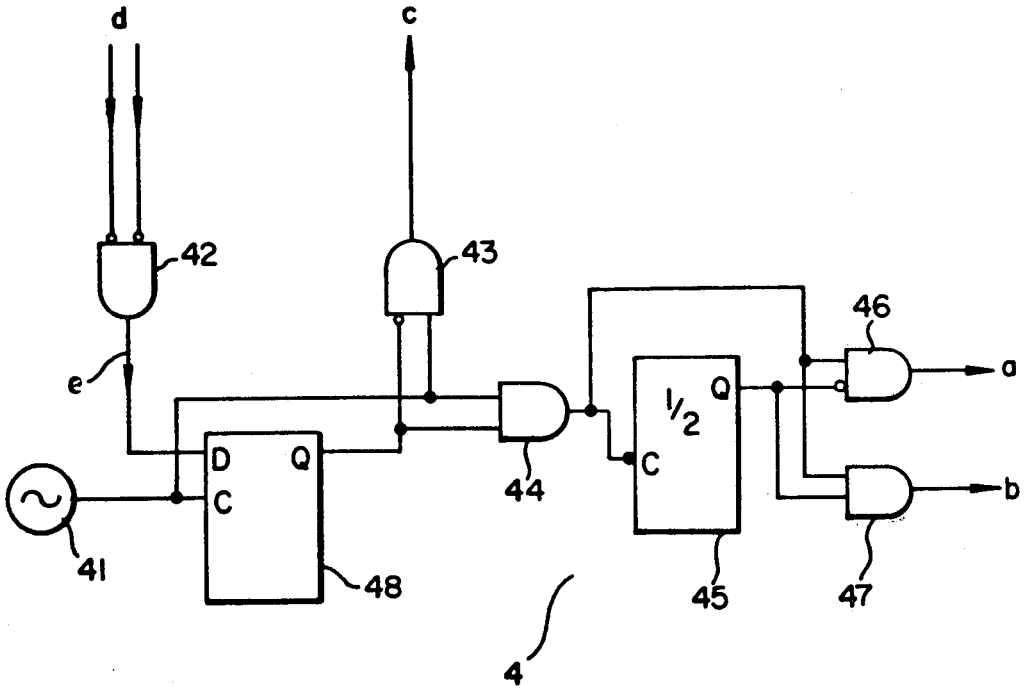
FIG. 2 is a detailed explanatory diagram of the principal part of the embodiment depicted in FIG. 1.

FIGS. 3A to 3H, inclusive, show a timing chart of operation associated with the control pulse generator of FIG. 2. FIG. 3A illustrates the waveform of a clock from the clock source, FIG. 3B the output waveform from the ½ frequency divider 45 for frequency dividing the output from the gate 44, and FIG. 3C the output waveform of the gate 46 for obtaining a negative logical product of the outputs from the gate 44 and the ½ frequency divider 45. The output from the gate 46 resets the latch circuits 2, 35 and 36. FIG. 3D shows the output waveform from the gate 47 for obtaining the logical products of the outputs from gate 44 and the ½ frequency divider 45. The output from gate 47 is applied as a clock to the latch circuit 2 to store the on-off state of the key switch. FIG. 3E shows the output waveform from the gate 42, which is applied as a clock to the latch circuit 35 to control not only the key code generation but also the memory circuit of the channel assignor described later. FIG. 3F shows an example of key code data provided by the waveform c on the busline from the latch circuit 35. In the event of four key switches being depressed, the key code data are sequentially outputted in accordance with priority of the key switches. FIG. 3G shows the output from the gate 42. The ON signal of the key switch of priority next to the key switch of top priority is applied in the form of "1" to the gate 34 shown in FIG. 1 to provide "0" to the gate 33, inhibiting it at all times. FIG. 3H shows the output waveform of the D type flip-flop 48.

Figure 4:
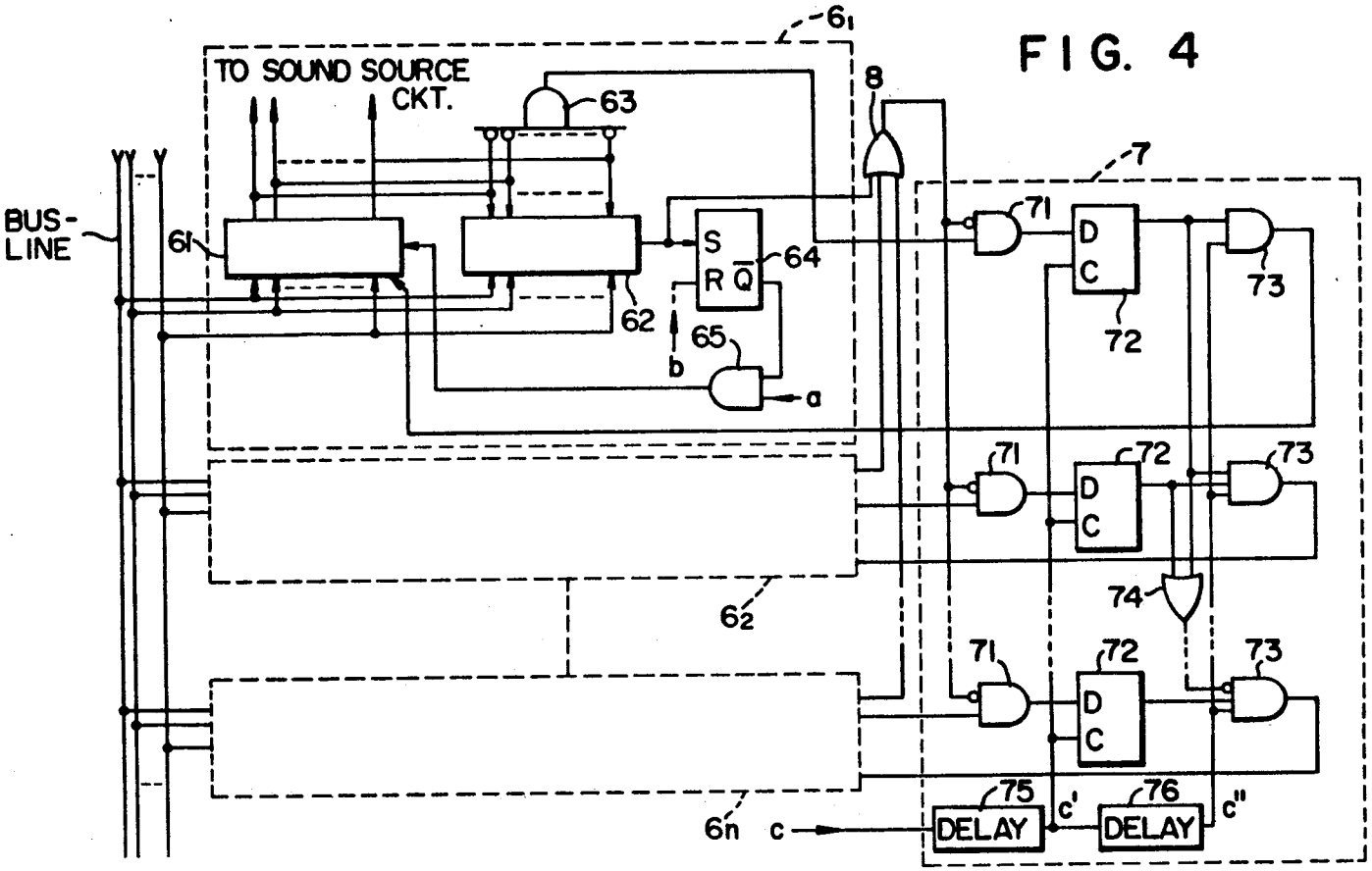
FIG. 4 is an explanatory diagram illustrating the construction of another embodiment of this invention.

FIG. 4 illustrates the construction of another embodiment for processing a signal outputted on the bus line in FIG. 1.

In FIG. 4, reference numerals $6_1$ to $6_n$ indicate key code memories and 7 designates a channel assignor.

In the key code memory 6, key code data are supplied in parallel to a latch circuit 61 and a comparator 62 from a bus line. The latch circuit 61 stores the key code and the comparator 62 compares the output from the latch circuit 61 with the date inputted from the bus line to provide an output "1" or "0" depending upon whether or not they match with each other. An RS flip-flop 64 is supplied at its set (S) terminal with the output from the comparator 62 to temporarily store the result of the comparison. To the reset (R) terminal of the RS flip-flop 64 is supplied the control pulse b in FIG. 2. A gate 63 is provided at the branched output of the latch circuit 61 and outputs "1" when no key code data are stored in the latch circuit 61. A gate 65 is controlled by the Q output from the flip-flop 64 and the control pulse a in FIG. 2. An OR gate 8 (FIG. 4) outputs the logical sum of the outputs from the comparators 62 of the key code memories $6_1$ to $6_n$ of the respective channels.

In the channel assignor 7, gates 71 are each controlled by the output from the gate 63 of each channel and the output from the OR gate 8. The output from the gate 71 is applied to the D terminal of a latch circuit 72, which is supplied at its C terminal with a pulse c' from a delay circuit 75 supplied with the pulse c in FIG. 2. Further, in the channel assignor 7, priority is given to the channels based on the same principle as the key priority circuit group 3 of the keyboard multiplexer. A gate circuit is formed with AND gates 73 and OR gates 74 so that when the outputs from two or more of the latch circuits 72 are "1," the output from the latch circuit 72 of top priority inhibits all of the other latch circuits 72. that is, the outputs from the latch circuits 72 are each applied to the gates 73 and, at the same time, branched to be supplied to the OR gates 74. Since top priority is given to the highest-pitched tone, no OR gate 74 is required for the highest-pitched tone. The output c in FIG. 2 is applied to the delay circuit 75 and is further applied to a delay circuit 76 to provide a pulse c'', which is supplied to the gates 73.

In these cases, priority of the channels $6_1$ to $6_n$ is $6_1 > 6_2 > \ldots 6_n$. Where any one of the channels $6_1$ to $6_n$ is idle or empty, the output from the gate 63 of the idle channel is "1," which is applied to the corresponding gate 71. For example, when one of the channels $6_1$ to $6_n$ does not match with the abovesaid data, the output from the OR gate 8 is "0" and the gates 71 each permit the passage therethrough of the output from each gate 63. The outputs from the gates 71 are captured by the latch circuits 72, respectively. With the AND gates 73 and the OR gates 74, the gate of the highest priority inhibits the other gates and the corresponding gate 73 provides an output "1." The signal "1" thus outputted from the gate 73 is applied to the latch circuit 61 of the corresponding channel by which the data on the bus line are latched.

If the data coincident with the abovesaid data are latched in any of the channels $6_1$ to $6_n$, a coincidence output from the corresponding comparator 62 is applied to the OR gate 8 to derive therefrom an output "1." This output "1" inhibits all of the gates 71, so that all the outputs from the channel assignor 7 are rendered "0."

That is, the same data are not stored in the other channels. In the timing chart shown in FIG. 3, the RS flip-flops 64 are all reset by the control pulse b at first and the data are processed by the pulses c′ and c″ derived from the pulse c. In this while comparison, channel assignment, latching, etc. are carried out and, after completion of these processings, the reset pulse a is provided. If the input data match with the data in any one of the channels during data processing, the RS flip-flop 64 is set by the output from the comparator 62 to preserve the coincidence. In case of coincidence, the Q output from the RS flip-flop becomes "0" to close the gate 65, leaving the latch circuit 61 in its non-reset state. Conversely, in case of non-coincidence, the Q output from the RS flip-flop 64 is "1" and the latch circuit 61 is reset by the rest pulse a through the gate 65.

In this manner, the information of the key switch being depressed is assigned to the corresponding channel and, by the information, the tone source and so on are controlled to generate the selected musical note. Upon release of the depressed key switch, generation of the musical note is stopped and the selected channel is opened.

As has been described in the foregoing, the key assignor of this invention is provided with a keyboard multiplexer which is composed of a memory for temporarily storing the state of key depression on a keyboard, a key priority circuit group operating to provide only key information of top priority while inhibiting the other key information outputs in accordance with priority of keys of the keyboard and to output key information of the next priority after being reset and a multiplex code generator for generating the key code corresponding to the key being depressed, and a channel assignor provided in combination with the abovesaid key code memory. With this keyboard multiplex system, such a wasteful scan part as in the prior art is omitted and the number of time slots on the bus line is limited only to the number of keys being depressed, so that a system of low redundancy can be obtained, in which a large amount of information can be processed in the same time, as compared with the other systems. Accordingly, the circuit of FIG. 1 is intended for the keyboard only but it is also possible to process information including information of a tablet switch, a crescendo pedal or an expression pedal.

Further, for the abovesaid reasons, detection of the key being depressed is rapid and the response time lag is small and, for the same reasons, the clock frequency can be set low. Moreover, if data are transmitted over bus lines, the amount of wiring required therefor is very small.

Further, with the channel assignor provided in combination with the key code memory, it is possible to automatically assign the key codes from the keyboard multiplexer to the channels, giving thereto priority, as described previously.

It will be apparent that many modifications and variations may be effected without departing from the scope of the novel concepts of this invention.

We claim:

1. A key assignor with a keyboard multiplexer comprising:

a first memory for temporarily storing the state of key depression on a keyboard and producing key depression signals;

a multiplex code generator for generating key codes respectively corresponding to each key;

an inhibit circuit for controlling the key depression signals from the first memory;

a priority circuit for outputting from the first memory only the key depression signal of top priority in accordance with a preset priority of keys of the keyboard;

a second memory for temporarily storing the key depression signal selected by the priority circuit and having an output which causes the multiplex code generator to generate a key code corresponding to the key being depressed;

a third memory directly responsive to said output of the second memory for storing the key depression signal stored in the second memory, and providing a signal to the inhibit circuit to inhibit further key depression signals;

reset means for providing a write signal which resets the second memory after a predetermined period of time and causes the priority circuit to shift the priority of the keys of the keyboard, whereby a key depression signal of the next priority is processed, and wherein upon all depressed keys are processed, a new state of key depression is written in the first memory and the same processing is repeatedly performed, whereby key codes corresponding to depressed keys are sequentially generated.

2. A key assignor according to claim 1, and further comprising a plurality of key code memory means for storing said key codes, each said key code memory means comprising a key code memory for storing a key code corresponding to a depressed key, a comparator for comparing the key code stored in the key code memory and a key code from the keyboard multiplexer to output a coincidence signal when they are coincident with each other, a fourth memory for temporarily storing the coincidence signal from the comparator, an empty key code memory detector for detecting whether or not a key code is stored in the key code memory to output an empty channel signal, a second inhibit circuit responsive to the output from the empty channel detector, a fifth memory for temporarily storing the output from the second inhibit circuit, and a channel priority circuit for prioritizing the fifth memories of all of said key code memory means to output a signal for writing a key code only in the empty key code memory of the highest priority, wherein responsive to no coincidence signal being provided from the comparator, the empty key code memory detector provides the empty channel signal, and the second inhibit circuit applies therethrough the empty channel signal to the fifth memory for storage therein to write the key code in the key code memory in accordance with the priority of the channel priority circuit for assigning the key code to a channel, and wherein responsive to a coincidence signal being provided from the comparator an inhibit signal is applied to the second inhibit circuit to inhibit the same key code from being written in two or more channels, and wherein responsive to where a key code coincident with the key code stored in the key code memory is not provided from the keyboard multiplexer in the state of the key code being already assigned to the channel, the fifth memory detects this to clear the content of the key code memory.

* * * * *